US010980090B1

(12) United States Patent
Chen et al.

(10) Patent No.: US 10,980,090 B1
(45) Date of Patent: Apr. 13, 2021

(54) LIGHT EMITTING DEVICE DRIVING APPARATUS AND DIMMING CONTROL CIRCUIT AND DIMMING CONTROL METHOD THEREOF

(71) Applicant: Richtek Technology Corporation, Zhubei (TW)

(72) Inventors: Yu-Min Chen, Taoyuan (TW); Isaac Y. Chen, Hsinchu (TW); Leng-Nien Hsiu, Hsinchu (TW)

(73) Assignee: RICHTEK TECHNOLOGY CORPORATION, Zhubei (TW)

( * ) Notice: Subject to any disclaimer, the term of this patent is extended or adjusted under 35 U.S.C. 154(b) by 0 days.

(21) Appl. No.: 16/850,958

(22) Filed: Apr. 16, 2020

(30) Foreign Application Priority Data

Oct. 15, 2019 (TW) ..... 108136977

(51) Int. Cl.

| | |
|---|---|
| ***H05B 37/00*** | (2006.01) |
| ***H05B 45/10*** | (2020.01) |
| ***H05B 45/325*** | (2020.01) |
| *H05B 45/385* | (2020.01) |
| *H05B 45/38* | (2020.01) |
| *H05B 45/375* | (2020.01) |

(52) U.S. Cl.
CPC ..... *H05B 45/10* (2020.01); *H05B 45/325* (2020.01); *H05B 45/375* (2020.01); *H05B 45/38* (2020.01); *H05B 45/385* (2020.01)

(58) Field of Classification Search
CPC ..... H05B 45/10; H05B 45/325; H05B 45/38; H05B 45/375; H05B 45/385
See application file for complete search history.

(56) References Cited

U.S. PATENT DOCUMENTS

2006/0145899 A1* 7/2006 Markowski ..... H02M 3/157 341/78
2010/0084991 A1* 4/2010 Liu ..... H05B 45/14 315/291
2017/0005583 A1 1/2017 Choi

FOREIGN PATENT DOCUMENTS

CN 106329961 A 6/2016

OTHER PUBLICATIONS

"Datasheet of TPS54200, TPS54201 4.5V to 28-V Input Voltage, 1.5A Output Current, Synchronous Buck Mono-Color or IR LED Driver" published by Texas Instruments.

* cited by examiner

*Primary Examiner* — Minh D A
(74) *Attorney, Agent, or Firm* — Tung & Associates

(57) ABSTRACT

AN LED driving apparatus includes a power stage circuit and a dimming control circuit. The power stage circuit drives an LED circuit. The dimming control circuit includes a duty ratio conversion circuit, a digital-to analog conversion (DAC) circuit, an error amplifier (EA) circuit and a modulation control circuit. The duty ratio conversion circuit converts a PWM dimming signal to a digital duty ratio signal. The DAC circuit converts the digital duty ratio signal to an analog reference signal. The EA circuit generates an error amplified signal according to a difference between the analog reference signal and an output current related signal. The modulation control circuit generates a PWM control signal according to the error amplified signal, to control the power switch, such that the output current relates to a dimming duty ratio, whereby the dimming control circuit dims the LED circuit according to the PWM dimming signal.

21 Claims, 6 Drawing Sheets

LIGHT EMITTING DEVICE DRIVING APPARATUS AND DIMMING CONTROL CIRCUIT AND DIMMING CONTROL METHOD THEREOF

CROSS REFERENCE

The present invention claims priority to TW 108136977 filed on Oct. 15, 2019.

BACKGROUND OF THE INVENTION

Field of Invention

The present invention relates to a light emitting device (LED) driving apparatus; particularly, it relates to such LED driving apparatus which can perform dimming control. The present invention also relates to a dimming control circuit and dimming control method.

Description of Related Art

Relevant prior arts of which the inventor is aware are: US Patent Application No. 2017/0005583 A1 and CN Patent Application No. 106329961A, and "Datasheet of TPS54200, TPS54201 4.5V to 28-V Input Voltage, 1.5A Output Current, Synchronous Buck Mono-Color or IR LED Driver" published by Texas Instruments.

Please refer to FIG. 1, which shows an operational waveform diagram of a conventional LED driving apparatus. This conventional LED driving apparatus filters a PWM dimming signal PWM_dim to generate a current reference signal, and generates an LED driving current ILED according to the current reference signal. The LED driving current ILED is positively proportional to a duty ratio of the PWM dimming signal PWM_dim.

The prior art shown in FIG. 1 has the following drawback that: because the current reference signal is generated by filtering the PWM dimming signal PWM_dim, when the duty ratio of the PWM dimming signal PWM_dim is very low (e.g., 1%), the level of the current reference signal is accordingly very low and larger ripples will occur. The design of a downstream circuit to cope with this issue is relatively more difficult, and undesirable flicker of the LED may occur.

As compared to the prior art in FIG. 1, the present invention is advantageous in that: the present invention generates the current reference signal via a duty ratio conversion circuit and a digital-to-analog conversion (DAC) circuit, whereby the level of the current reference signal can be adjusted with more flexibility. As a result, the design criteria of a downstream circuit is less strict, thus reducing the cost. Moreover, basically there is no ripple, so the light generated by the LED is very stable.

SUMMARY OF THE INVENTION

From one perspective, the present invention provides a light emitting device (LED) driving apparatus, comprising: a power stage circuit, which includes: an inductor; and a power switch coupled to the inductor, wherein the power switch is configured to operably control the inductor, so as to convert an input power to an output current for driving an LED circuit; and a dimming control circuit, which is configured to operably control the power switch, wherein the dimming control circuit includes: a duty ratio conversion circuit, which is configured to operably convert a PWM dimming signal to a digital duty ratio signal, wherein the digital duty ratio signal corresponds to a dimming duty ratio of the PWM dimming signal; a first digital-to-analog conversion (DAC) circuit, which is configured to operably convert the digital duty ratio signal to an analog reference signal; an error amplifier (EA) circuit, which is configured to operably generate an error amplified signal according to a difference between the analog reference signal and an output current related signal, wherein the output current related signal is related to the output current; and a modulation control circuit, which is configured to operably generate a PWM control signal according to the error amplified signal, to control the power switch, so as to regulate the output current such that the output current is related to the dimming duty ratio, whereby the dimming control circuit dims the LED circuit according to the PWM dimming signal.

In one embodiment, the LED driving apparatus further comprises: a current sensing device, which is configured to operably generate a current sensing signal according to the output current; wherein the dimming control circuit further includes: a current signal amplification circuit, which is configured to operably amplify the current sensing signal via fully differential configuration, to generate the output current related signal.

In one embodiment, the LED driving apparatus further comprises: a filter circuit coupled between the current sensing device and the current signal amplification circuit, the filter circuit being configured to operably filter a voltage across the current sensing device, to generate the current sensing signal.

In one embodiment, the duty ratio conversion circuit includes: a pulse generation circuit, which is configured to operably detect a starting time point of the dimming duty ratio of the PWM dimming signal to generate a starting pulse, and to operably detect an ending time point of the dimming duty ratio of the PWM dimming signal to generate an ending pulse, wherein a period of the starting pulse and a period of the ending pulse both correspond to a dimming signal period of the PWM dimming signal; a timer clock circuit, which is configured to operably generate a timer clock signal according to a period pulse, wherein the timer clock circuit adjusts a period of the timer clock signal, to regulate a duration by which the timer clock signal counts to a predetermined full scale value, such that the period of the timer clock signal is substantially equal to the dimming signal period; wherein the period pulse corresponds to either the starting pulse or the ending pulse; and a duty ratio counter circuit, which is configured to operably count according to the timer clock signal, to generate the digital duty ratio signal, wherein the duty ratio counter circuit is triggered to start counting by the starting pulse and is triggered to stop counting by the ending pulse, so as to generate the digital duty ratio signal, wherein a ratio of a count value of the digital duty ratio signal to the predetermined full scale value corresponds to the dimming duty ratio.

In one embodiment, the timer clock circuit includes: a reference clock generation circuit, which is configured to operably generate a reference clock signal; a first up-down counter circuit, which is configured to operably generate the timer clock signal according to the reference clock signal, an up-counting signal and a down-counting signal; a period counter circuit, which is configured to operably count according to the timer clock signal and the period pulse during the dimming signal period, to generate a period counting number; and a period comparison circuit, which is configured to operably compare the period counting number with the predetermined full scale value, to generate the up-counting signal and the down-counting signal so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

In one embodiment, the duty ratio counter circuit latches the digital duty ratio signal according to the ending pulse.

In one embodiment, the timer clock circuit includes: an adjustable clock generation circuit, which is configured to operably generate the timer clock signal according to an analog adjustment signal; a second up-down counter circuit, which is configured to operably generate a digital adjustment signal according to an up-counting signal and a down-counting signal; a second digital-to-analog conversion (DAC) circuit, which is configured to operably convert the digital adjustment signal to the analog adjustment signal; a period counter circuit, which is configured to operably count according to the timer clock signal and the period pulse during the dimming signal period, to generate a period counting number; and a period comparison circuit, which is configured to operably compare the period counting number with the predetermined full scale value, to generate the up-counting signal and the down-counting signal so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

In one embodiment, the duty ratio counter circuit latches the digital duty ratio signal according to the ending pulse.

In one embodiment, the power stage circuit includes one of the following: (1) a buck switching power stage; (2) a boost switching power stage; (3) a buck-boost switching power stage; or (4) a flyback switching power stage.

From another perspective, the present invention provides a dimming control circuit, which is configured to operably control an LED driving apparatus, wherein the LED driving apparatus includes a power stage circuit, the power stage circuit including: an inductor; and a power switch coupled to the inductor, wherein the power switch is configured to operably control the inductor to convert an input power to an output current for driving an LED circuit; wherein the dimming control circuit is configured to operably control the power switch; the dimming control circuit comprising: a duty ratio conversion circuit, which is configured to operably convert a PWM dimming signal to a digital duty ratio signal, wherein the digital duty ratio signal corresponds to a dimming duty ratio of the PWM dimming signal; a first digital-to-analog conversion (DAC) circuit, which is configured to operably convert the digital duty ratio signal to an analog reference signal; an error amplifier (EA) circuit, which is configured to operably generate an error amplified signal according to a difference between the analog reference signal and an output current related signal, wherein the output current related signal is related to the output current; and a modulation control circuit, which is configured to operably generate a PWM control signal according to the error amplified signal, to control the power switch, so as to regulate the output current such that the output current is related to the dimming duty ratio, whereby the dimming control circuit dims the LED circuit according to the PWM dimming signal.

From yet another perspective, the present invention provides a dimming control method, which is configured to operably control an LED driving apparatus, wherein the LED driving apparatus includes a power stage circuit, the power stage circuit including: an inductor; and a power switch coupled to the inductor, wherein the power switch is configured to operably control the inductor to convert an input power, so as to generate an output current for driving an LED circuit; wherein the dimming control method is configured to operably control the power switch; the dimming control method comprising: converting a PWM dimming signal to a digital duty ratio signal, wherein the digital duty ratio signal corresponds to a dimming duty ratio of the PWM dimming signal; converting the digital duty ratio signal to an analog reference signal; and generating a PWM control signal according to a difference between the analog reference signal and an output current related signal, to control the power switch, so as to regulate the output current such that the output current is related to the dimming duty ratio, whereby the dimming control circuit dims the LED circuit according to the PWM dimming signal.

In one embodiment, the dimming control method further comprises: amplifying a current sensing signal via fully differential configuration, to generate the output current related signal; wherein the dimming control circuit further includes: a current sensing device, which is configured to operably generate the current sensing signal according to the output current.

In one embodiment, the step of generating the digital duty ratio signal includes: generating a timer clock signal according to a dimming signal period of the PWM dimming signal; counting according to the timer clock signal; adjusting a period of the timer clock signal, to regulate a duration by which the timer clock signal counts to a predetermined full scale value, such that the period of the timer clock signal is substantially equal to the dimming signal period; and starting to count at a starting time point of a duty of the PWM dimming signal according to the timer clock signal and stopping counting at an ending time point of the duty of the PWM dimming signal, so as to generate the digital duty ratio signal, wherein a ratio of a count value of the digital duty ratio signal to the predetermined full scale value corresponds to the dimming duty ratio.

In one embodiment, the step of adjusting the period of the timer clock signal includes: generating a reference clock signal; performing an up-counting or a down-counting according to the reference clock signal, to generate the timer clock signal; counting according to the timer clock signal and the period pulse during the dimming signal period, to generate a period counting number; and comparing the period counting number with the predetermined full scale value, so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

In one embodiment, the step of generating the timer clock signal includes: generating a digital adjustment signal by up-counting or down-counting; converting the digital adjustment signal to an analog adjustment signal; generating the timer clock signal according to the analog adjustment signal; counting according to the timer clock signal and the period pulse during the dimming signal period, to generate a period counting number; and comparing the period counting number with the predetermined full scale value, to upwardly or downwardly adjust the digital adjustment signal so as to adjust the period of the timer clock signal, whereby the duration by which the timer clock signal counts to the predetermined full scale value is regulated, such that the period of the timer clock signal is substantially equal to the dimming signal period.

The objectives, technical details, features, and effects of the present invention will be better understood with regard to the detailed description of the embodiments below, with reference to the attached drawings.

DESCRIPTION OF THE PREFERRED EMBODIMENTS

The drawings as referred to throughout the description of the present invention are for illustration only, to show the interrelations between the circuits and the signal waveforms, but not drawn according to actual scale of circuit sizes and signal amplitudes and frequencies.

Figure 1:
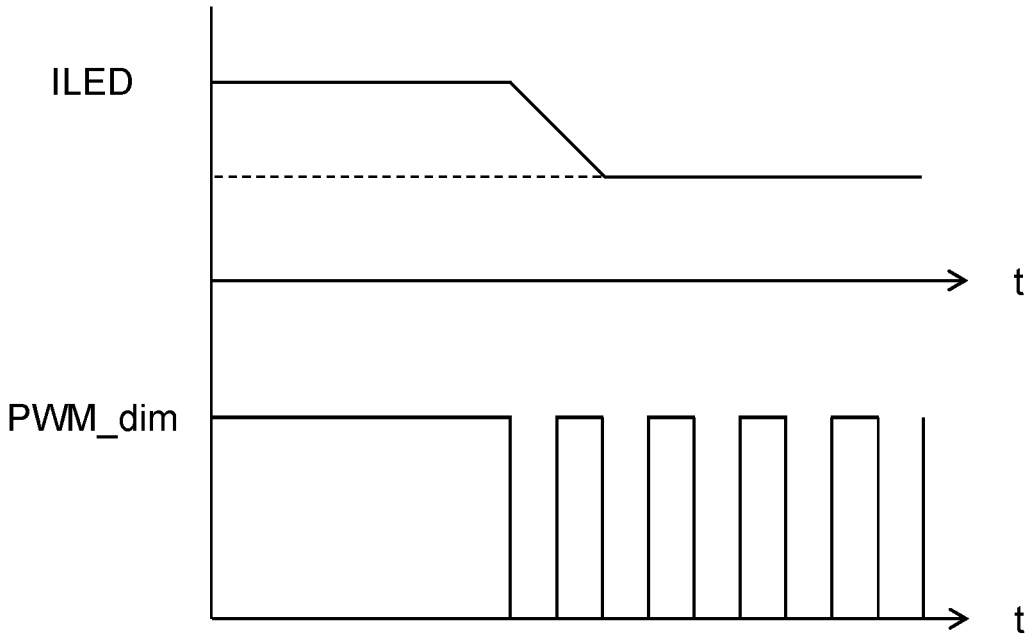
Fig. 1 (Prior Art)
FIG. 1 shows an operational waveform diagram of a conventional LED driving apparatus.
Figure 2:
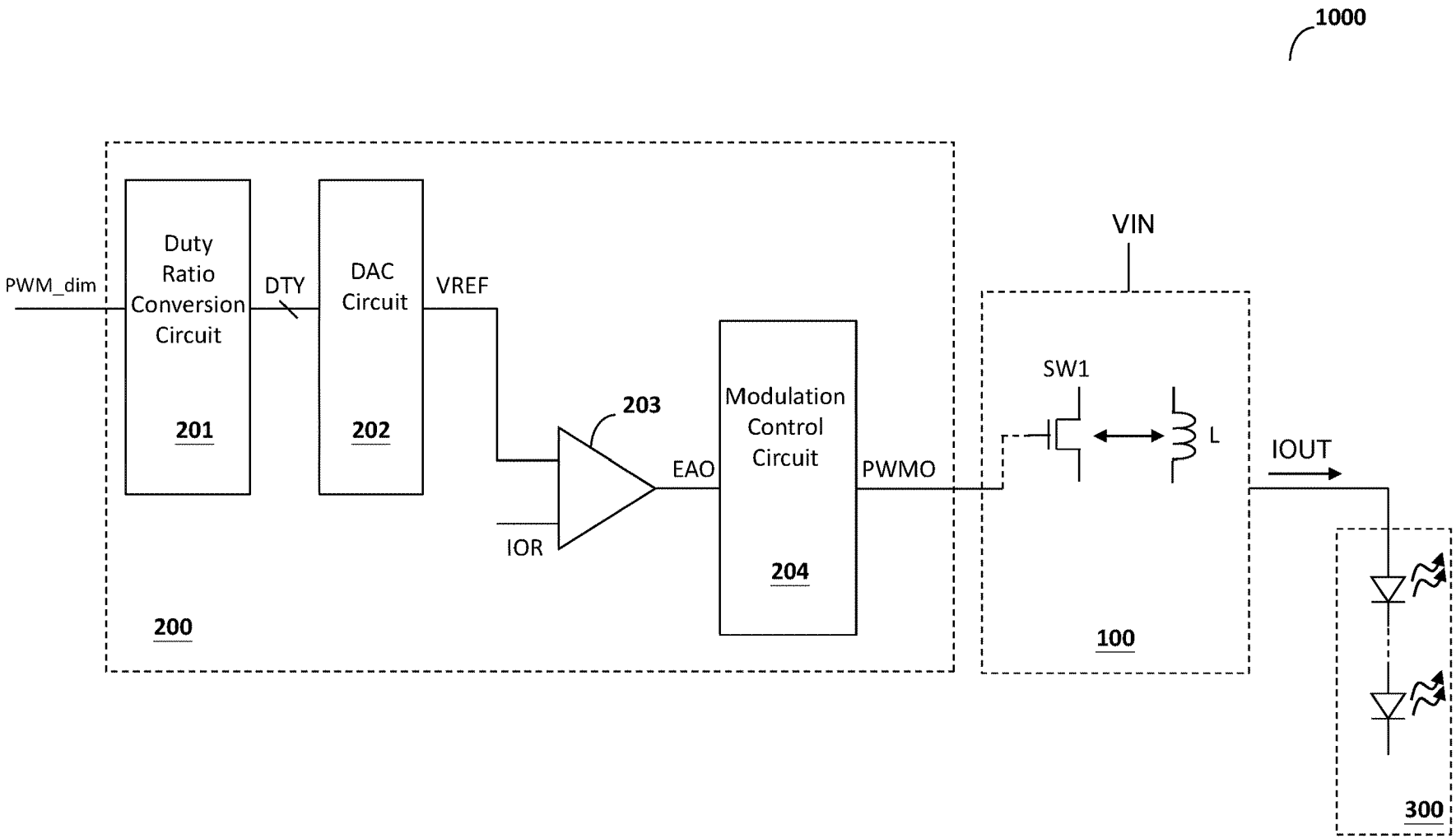
FIG. 2 shows a schematic block diagram of an LED driving apparatus according to an embodiment of the present invention.
Figure 3A:
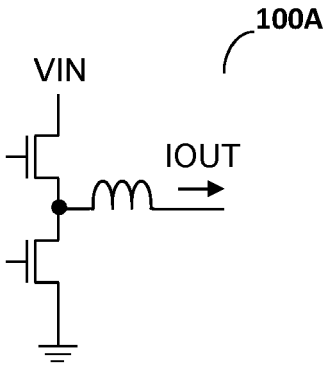
FIGS. 3A-3E show several embodiments of a power stage circuit.
Figure 3B:
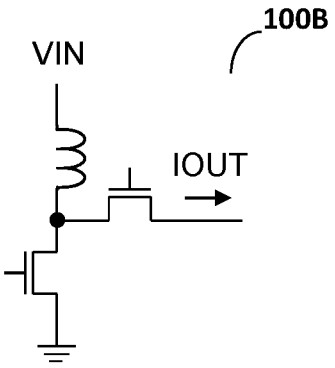
Figure 3C:
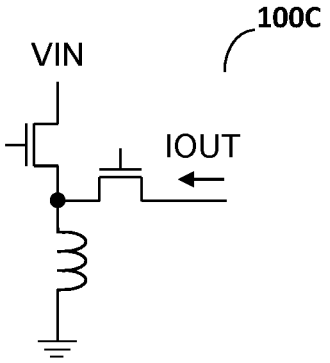
Figure 3D:
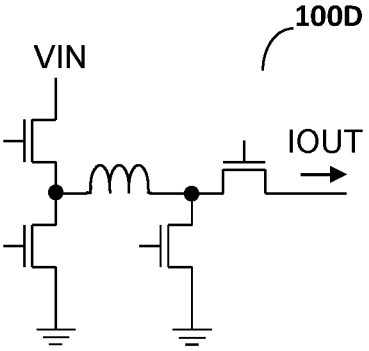
Figure 3E:
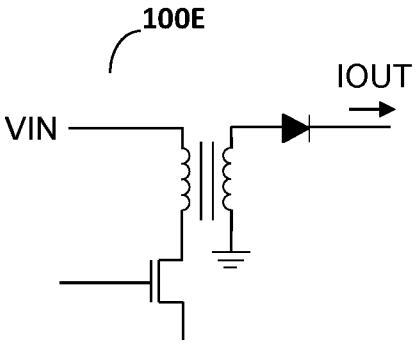

Please refer to FIG. 2, which shows a schematic block diagram of an LED driving apparatus (i.e., LED driving apparatus 1000) according to an embodiment of the present invention. In this embodiment, the LED driving apparatus 1000 comprises: a power stage circuit 100 and a dimming control circuit 200.

In one embodiment, the power stage circuit 100 includes: an inductor L and a power switch SW1. The power switch SW1 is coupled to the inductor L. The power switch SW1 is configured to operably control the inductor L to convert an input power VIN to an output current VIN for driving an LED circuit 300.

Please refer to FIGS. 3A-3E, which show several embodiments of the power stage circuit (i.e., power stage circuits 100A to 100E). It should be understood that these embodiments are illustrative examples, and other types of power stage circuits are also within the scope of the present invention. The power stage circuit (which corresponds to the power stage circuit 100 as shown in FIG. 2) can be implemented as one of the following: a buck switching power stage (as shown by the power stage circuit 100A in FIG. 3A); a boost switching power stage (as shown by the power stage circuit 100B in FIG. 3B); a buck-boost switching power stage (as shown by the power stage circuit 100C or 100D in FIG. 3C or FIG. 3D); or a flyback switching power stage (as shown by the power stage circuit 100E in FIG. 3E). Note that, the above-mentioned power switch SW1 can correspond to anyone of the power switches in the power stage circuits 100A to 100E, whereas, the above-mentioned inductor L can correspond to anyone of the inductors in the power stage circuits 100A to 100D or the windings in the power stage circuit 100E.

Please refer to FIG. 2. The dimming control circuit 200 is configured to operably control the power switch SW1. In one embodiment, the dimming control circuit 200 includes: a duty ratio conversion circuit 201, a first digital-to-analog conversion (DAC) circuit 202, an error amplifier (EA) circuit 203 and a modulation control circuit 204.

As shown in FIG. 2, the duty ratio conversion circuit 201 is configured to operably convert a PWM dimming signal PWM_dim to a digital duty ratio signal DTY. The digital duty ratio signal DTY corresponds to a dimming duty ratio of the PWM dimming signal PWM_dim. More specifically, in one embodiment, the "digital duty ratio signal DTY" is a digital signal including at least one bit. A ratio of a value represented by the at least one bit to a predetermined full scale value corresponds to the dimming duty ratio of the PWM dimming signal PWM_dim. For a non-limitative example, the digital duty ratio signal DTY for example can include eight bits having a decimal value of for example 127. The predetermined full scale value for example can be 255. Under such circumstance, the dimming duty ratio of the PWM dimming signal PWM_dim is substantially equal to ½.

Note that, as one of average skill in the art will readily understand, the term "PWM" refers to pulse width modulation; besides, in one embodiment, the dimming duty ratio corresponds to a ratio of the duration of a high level of the PWM dimming signal PWM_dim to a period of the PWM dimming signal PWM_dim. Also note that, because there may be imperfectness during manufacturing the components and/or the circuits, the term "substantially" is used to mean that an insignificant error within a tolerable range is acceptable.

In one embodiment, the above-mentioned dimming duty ratio of the PWM dimming signal PWM_dim is used to adjust light-emitting characteristics (e.g., brightness or color temperature) of the LED circuit 300. In one embodiment, brightness of the LED circuit 300 is positively correlated to the dimming duty ratio. In one embodiment, the brightness of the LED circuit 300 is positively proportional to the dimming duty ratio.

Please still refer to FIG. 2. The first DAC circuit 202 is configured to operably convert the digital duty ratio signal DTY to an analog reference signal VREF. In one embodiment, there is a linear ratio relationship between the analog reference signal VREF and the digital duty ratio signal DTY. In another embodiment, there is a non-linear ratio relationship between the analog reference signal VREF and the digital duty ratio signal DTY. In some embodiments, the analog reference signal VREF can include an offset value; that is, the analog reference signal VREF is not zero (but instead corresponds to an offset value) when the digital duty ratio signal DTY is zero. As such, the design criteria of a downstream circuit (e.g., the EA circuit 203) is less strict, which reduces the cost.

Please still refer to FIG. 2. The EA circuit 203 is configured to operably generate an error amplified signal EAO according to a difference between the analog reference signal VREF and an output current related signal IOR. The output current related signal IOR is related to the output current IOUT. In one embodiment, the output current related signal IOR is positively proportional to the output current IOUT. The modulation control circuit 204 is configured to operably generate a PWM control signal PWMO according to the error amplified signal EAO, to control the power switch SW1, so as to regulate the output current IOUT so that the output current IOUT is related to the dimming duty ratio, whereby the dimming control circuit 200 dims the LED circuit 300 according to the PWM dimming signal PWM_dim.

In one embodiment, the duty ratio of an ON-period of the power switch SW1 is correlated with a duty ratio of the PWM dimming signal PWM_dim. The actual relationship between the duty ratio of the ON-period of the power switch SW1 and the duty ratio of the PWM dimming signal PWM_dim is related to the power stage circuit that is adopted; for example, the duty ratio of the ON-period of the power switch SW1 can be of the same phase and the same ratio as the duty ratio of the PWM dimming signal PWM_dim, i.e., indirect correspondence. In other examples, the correspondence can be arranged otherwise. In one embodiment, the PWM control signal PWMO is generated for example by comparing the error amplified signal EAO with a ramp signal, to generate the PWM control signal PWMO in fixed frequency pulse width modulation or variable frequency pulse width modulation, under a voltage mode, a current mode, or a constant time mode. etc., wherein the ramp signal can be related or not related to a slop of the inductor current.

In another embodiment, the modulation control circuit 204 is configured to operably generate a linear control signal according to the error amplified signal EAO, to control a power stage circuit having a linear power switch, to regulate the output current IOUT such that the output current IOUT is related to the dimming duty ratio.

Note that, in the present invention, the approach for dimming LED circuit 300 is not limited to controlling the output current IOUT to be related to the dimming duty ratio. In other embodiments, it is also practicable and within the scope of the present invention that the power switch SW1 can be controlled in a way such that the output voltage or the output power is related to the dimming duty ratio, whereby the dimming control circuit 200 dims the LED circuit 300 according to the PWM dimming signal PWM_dim.

Figure 4:
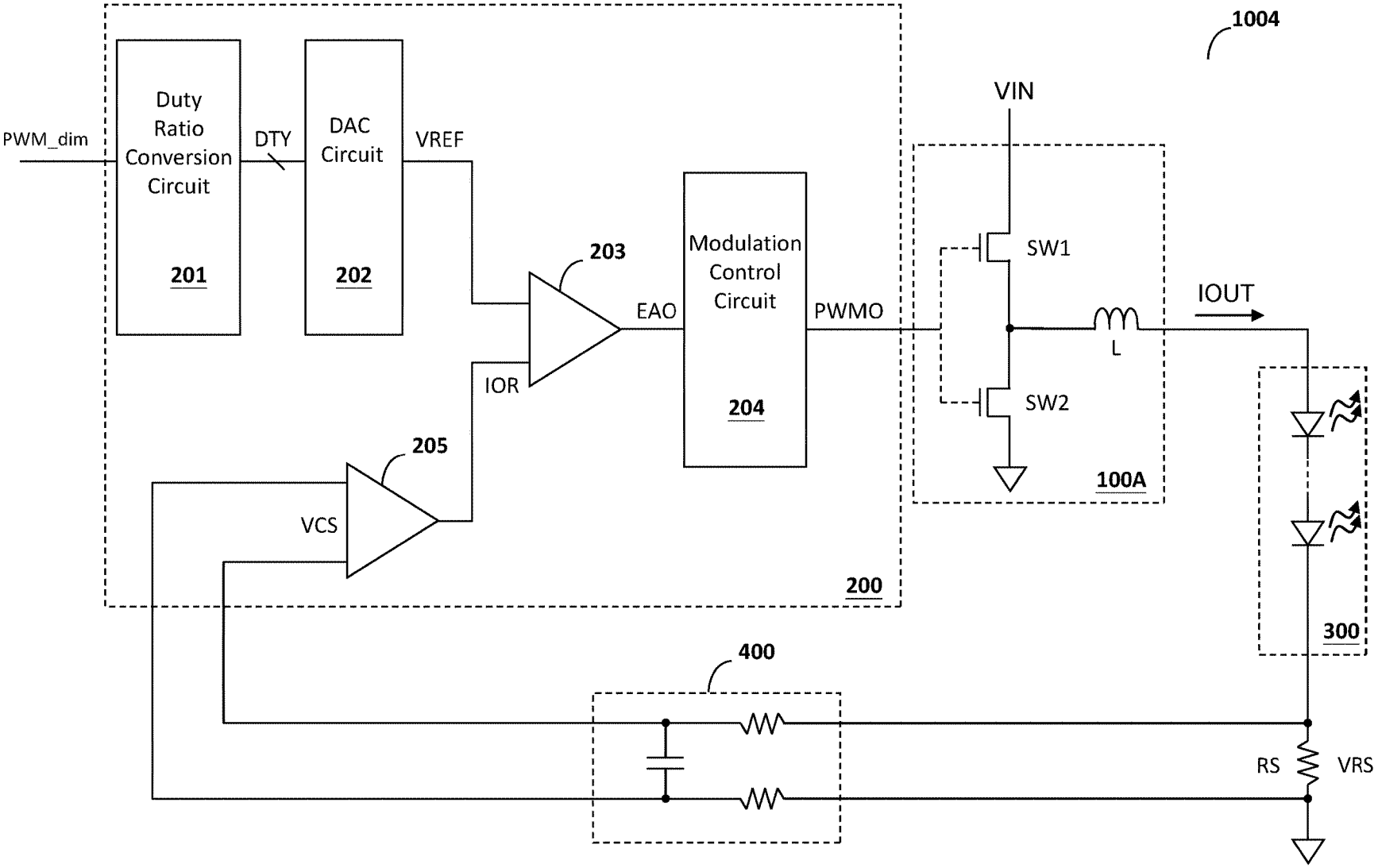
FIG. 4 shows a schematic block diagram of an LED driving apparatus according to an embodiment of the present invention.

Please refer to FIG. 4, which shows a schematic block diagram of an LED driving apparatus (i.e., LED driving apparatus 1004) according to an embodiment of the present invention. As shown in FIG. 4, in one embodiment, the LED driving apparatus 1004 further comprises a current sensing device RS. The current sensing device RS is configured to operably generate a current sensing signal VCS according to the output current IOUT. In one embodiment, the current sensing device RS is arranged to be located in at least one current path of the output current IOUT. In the example shown in FIG. 4, the power stage circuit 100A corresponds to a buck power stage circuit which includes a power switch SW1, a power switch SW2 and an inductor L which form a buck power stage circuit; in this embodiment, the current sensing device RS is connected in series to a current path of the LED circuit 300. In this embodiment, the current sensing device RS is configured to operably sense a conduction current (which corresponds to the output current IOUT) flowing through the current path of the LED circuit 300, so as to generate the current sensing signal VCS.

Please still refer to FIG. 4. In this embodiment, the dimming control circuit 200 further includes: a current signal amplification circuit 205, which is configured to operably amplify the current sensing signal VCS via fully differential configuration, to generate the output current related signal IOR. As such, the design criteria of a downstream circuit (e.g., the EA circuit 203) can be less strict, thus reducing the cost. ("Fully differential configuration" is to generate a signal by a difference between a positive signal and a negative signal, which is well known by one skilled in this art, so the details thereof are not redundantly explained here.)

Please still refer to FIG. 4. In this embodiment, the LED driving apparatus can further comprise a filter circuit 400. The filter circuit 400 is coupled between the current sensing device RS and the current signal amplification circuit 205. The filter circuit 400 is configured to operably filter a voltage VRS across the current sensing device RS, to generate the current sensing signal VCS.

Figure 5:
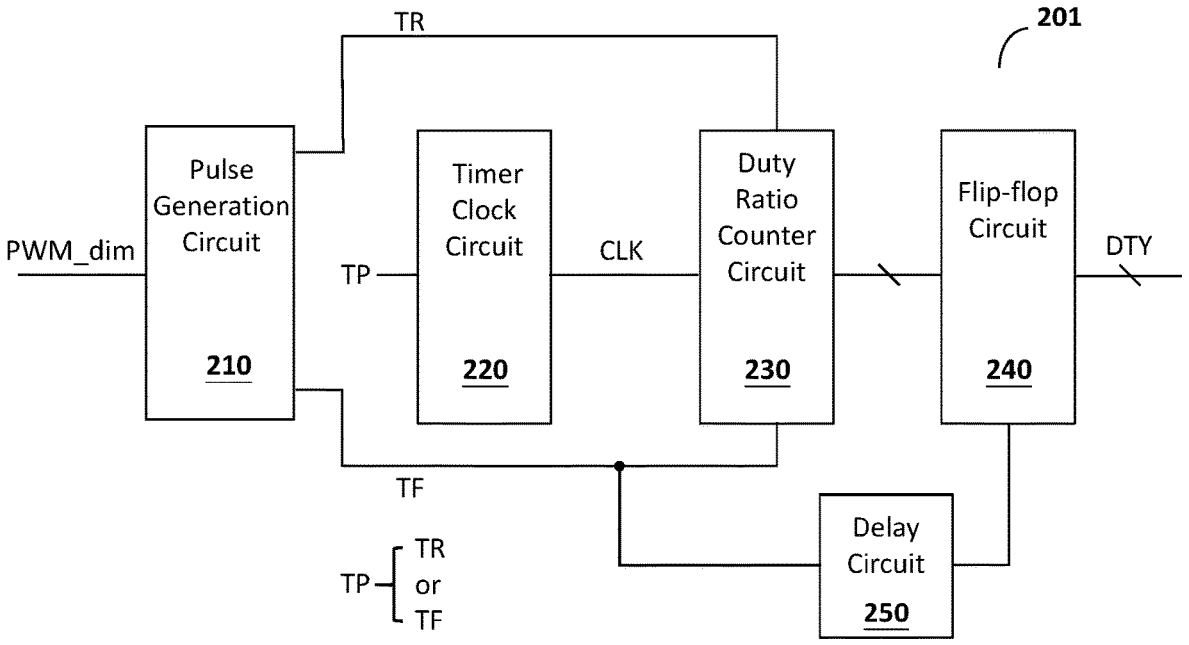
FIG. 5 shows an embodiment of a duty ratio conversion circuit.
Figure 6:
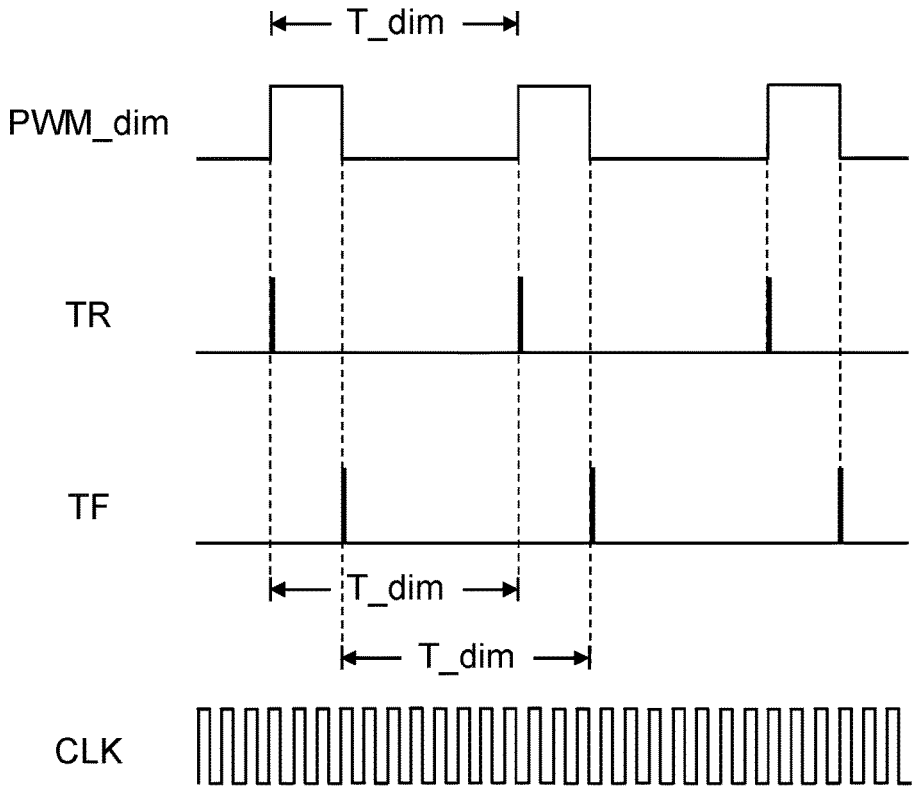
FIG. 6 shows an operational waveform diagram of an LED driving apparatus according of the present invention.

Please refer to FIG. 5 along with FIG. 6. FIG. 5 shows an embodiment of a duty ratio conversion circuit (i.e., duty ratio conversion circuit 201). FIG. 6 shows an operational waveform diagram of an LED driving apparatus according of the present invention. As shown in FIG. 5, in one embodiment, the duty ratio conversion circuit 201 includes: a pulse generation circuit 210, a timer clock circuit 220 and a duty ratio counter circuit 230.

The pulse generation circuit 210 is configured to operably detect a starting time point (for example but not limited to a rising edge of the PWM dimming signal PWM_dim in FIG. 6) of the duty (ON-period) of the PWM dimming signal PWM_dim to generate a starting pulse TR. Besides, the pulse generation circuit 210 is configured to operably detect an ending time point (for example but not limited to a falling edge of the PWM dimming signal PWM_dim in FIG. 6) of the duty (ON-period) of the PWM dimming signal PWM_dim to generate an ending pulse TF. As shown in FIG. 6, the period of the starting pulse TR and the period of the ending pulse TF are both T dim, which corresponds to the dimming signal period T dim of the PWM dimming signal PWM_dim. (By "period of the pulse", it is intended to refer to the time between two pulses, not the short time length of the pulse.)

The timer clock circuit 220 is configured to operably generate a timer clock signal CLK according to a period pulse TP (which for example can be the starting pulse TR or the ending pulse TF). According to the present invention, in one embodiment, the timer clock circuit 220 adjusts a period of the timer clock signal CLK, to regulate a duration by which the timer clock signal CLK counts to a predetermined full scale value, such that the period of the timer clock signal CLK is substantially equal to the dimming signal period T dim. For example, assuming that the predetermined full scale value is 255 and the period of the timer clock signal CLK is Tck, according to the present invention, the timer clock circuit 220 can adjust the period Tck of the timer clock signal CLK, such that Tck*255 is equal to T dim. The implementation details of the timer clock circuit 220 will be explained later.

As shown in FIG. 6, in one embodiment, the frequency of the timer clock signal CLK is several fold, several 10-fold or several 100-fold of the frequency of the PWM dimming signal PWM_dim; the actual number relationship can be determined according to a resolution required to represent the duty of the PWM dimming signal PWM_dim.

The duty ratio counter circuit 230 is configured to operably count according to the timer clock signal CLK, to generate the digital duty ratio signal DTY. More specifically, in one embodiment, the duty ratio counter circuit 230 is triggered to start counting by the starting pulse TR and is triggered to stop counting by the ending pulse TF, so as to generate the digital duty ratio signal DTY. A ratio of a count value of the digital duty ratio signal DTY to the predetermined full scale value corresponds to the dimming duty ratio.

Please still refer to FIG. 5. In one embodiment, the duty ratio counter circuit 230 latches the digital duty ratio signal DTY according to the ending pulse TF. More specifically, in one embodiment, the duty ratio conversion circuit 201 can include a latch circuit (for example but not limited to a flip-flop circuit 240 in FIG. 5). In this embodiment, the flip-flop circuit 240 latches an output of the duty ratio counter circuit 230 according to the ending pulse TF, so as to generate the digital duty ratio signal DTY. In one embodiment, as shown in FIG. 5, a delay circuit 250 can be employed to delay the ending pulse TF, to ensure that the flip-flop circuit 240 is triggered at a proper timing to latch the output of the duty ratio counter circuit 230.

Figure 7A:
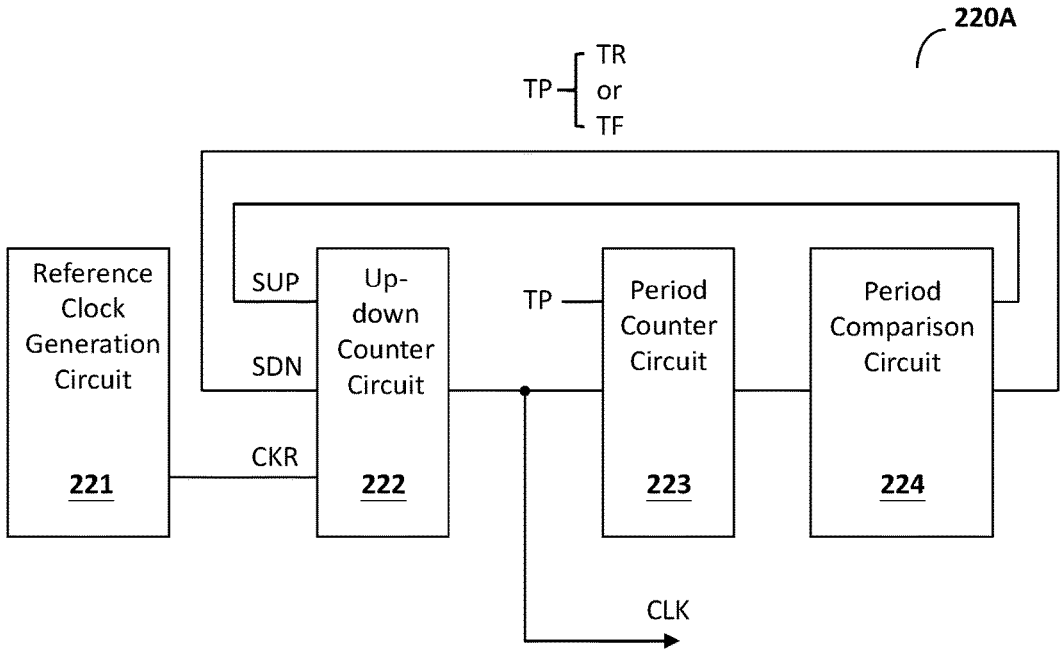
FIGS. 7A and 7B show two embodiments of a timer clock circuit, respectively.
Figure 7B:
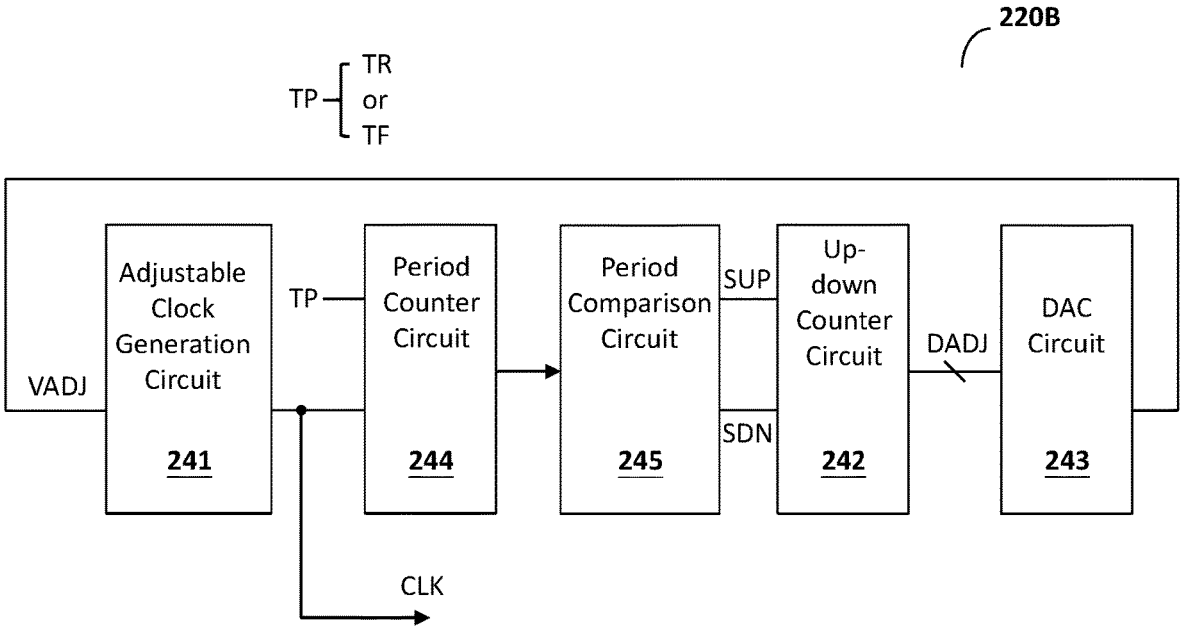

Please refer to FIGS. 7A and 7B, which show two embodiments of a timer clock circuit (i.e., timer clock circuit 220A and timer clock circuit 220B), respectively.

As shown in FIG. 7A, in one embodiment, the timer clock circuit 220A includes: a reference clock generation circuit 221, an up-down counter circuit 222, a period counter circuit 223 and a period comparison circuit 224.

Please still refer to FIG. 7A. In this embodiment, the reference clock generation circuit 221 is configured to operably generate a reference clock signal CKR. The up-down counter circuit 222 is configured to operably generate the timer clock signal CLK according to the reference clock signal CKR, an up-counting signal SUP and a down-counting signal SDN. The frequency of the reference clock signal CKR is several fold, several 10-fold or several 100-fold of the frequency of the timer clock signal CLK. The actual number relationship can be determined according to the resolution required for adjusting the timer clock signal CLK.

The period counter circuit 223 is configured to operably count during the dimming signal period T dim according to the timer clock signal CLK and the period pulse TP, to generate a period counting number. Because the period counter circuit 223 is configured to operably count during the dimming signal period T dim, in one embodiment, the above-mentioned period pulse TP can correspond to the starting pulse TR. In another embodiment, the above-mentioned period pulse TP can correspond to the ending pulse TF.

The period comparison circuit 224 is configured to operably compare the period counting number with the predetermined full scale value, to generate the up-counting signal SUP and the down-counting signal SDN for controlling a counting direction of the up-down counter circuit 222, so as to adjust the period of the timer clock signal CLK is adjusted, to regulate the duration by which the timer clock signal CLK counts to the predetermined full scale value, such that the period of the timer clock signal CLK is substantially equal to the dimming signal period T dim.

More specifically, in one embodiment, when the period counting number is smaller than the predetermined full scale value, it indicates that the period of the timer clock signal CLK is too long. Under such situation, in one embodiment, the present invention can use the down-counting signal SDN to control the up-down counter circuit 222 to count down, thus shortening the period of the timer clock signal CLK. As a result, the duration by which the timer clock signal CLK counts to a predetermined full scale value is shortened, such that the period of the timer clock signal CLK is substantially equal to the dimming signal period T dim. Under an opposite situation where the period counting number is greater than the predetermined full scale value (which indicates that the period of the timer clock signal CLK is too short), the present invention can use the up-counting signal SUP to control the up-down counter circuit 222 to count up.

Please refer to FIG. 7B. In this embodiment, the timer clock circuit includes: an adjustable clock generation circuit 241, an up-down counter circuit 242, a second conversion DAC circuit 243, a period counter circuit 244 and a period comparison circuit 245.

Please still refer to FIG. 7B. The adjustable clock generation circuit 241 is configured to operably generate the timer clock signal CLK according to an analog adjustment signal VADJ. The up-down counter circuit 242 is configured to operably generate a digital adjustment signal DADJ according to the up-counting signal SUP and the down-counting signal SDN. The DAC circuit 243 is configured to operably convert the digital adjustment signal DADJ to the analog adjustment signal VADJ. The period counter circuit 244 is configured to operably count during the dimming signal period T dim according to the timer clock signal CLK and the period pulse TP, to generate a period counting number. Because the period counter circuit 244 is configured to operably count during the dimming signal period T dim, in one embodiment, the above-mentioned period pulse TP can correspond to the starting pulse TR. In another embodiment, the above-mentioned period pulse TP can correspond to the ending pulse TF.

Please still refer to FIG. 7B. The period comparison circuit 245 is configured to operably compare the period counting number with the predetermined full scale value, to generate the up-counting signal SUP and the down-counting signal SDN for controlling a counting direction of the up-down counter circuit 242, so as to adjust the period of the timer clock signal CLK is adjusted, to regulate the duration by which the timer clock signal CLK counts to the predetermined full scale value, such that the period of the timer clock signal CLK is substantially equal to the dimming signal period T dim.

More specifically, in one embodiment, when the period counting number is smaller than the predetermined full scale value, it indicates that the period of the timer clock signal CLK is too long. Under such situation, in one embodiment, the present invention can use the down-counting signal SDN to control the up-down counter circuit 242 to count down, thus shortening the period of the timer clock signal CLK. As a result, the duration by which the timer clock signal CLK counts to a predetermined full scale value is shortened, such that the period of the timer clock signal CLK is substantially equal to the dimming signal period T dim. Under an opposite situation where the period counting number is greater than the predetermined full scale value (which indicates that the period of the timer clock signal CLK is too short), the present invention can use the up-counting signal SUP to control the up-down counter circuit 242 to count up.

The present invention has been described in considerable detail with reference to certain preferred embodiments thereof. It should be understood that the description is for illustrative purpose, not for limiting the scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment. In view of the foregoing, the spirit of the present invention should cover all such and other modifications and variations, which should be interpreted to fall within the scope of the following claims and their equivalents.

What is claimed is:

1. A light emitting device (LED) driving apparatus, comprising:

a power stage circuit, which includes:

an inductor; and a power switch coupled to the inductor, wherein the power switch is configured to operably control the inductor, so as to convert an input power to an output current for driving an LED circuit; and a dimming control circuit, which is configured to operably control the power switch, wherein the dimming control circuit includes:

a duty ratio conversion circuit, which is configured to operably convert a PWM dimming signal to a digital duty ratio signal, wherein the digital duty ratio signal corresponds to a dimming duty ratio of the PWM dimming signal;

a first digital-to-analog conversion (DAC) circuit, which is configured to operably convert the digital duty ratio signal to an analog reference signal;

an error amplifier (EA) circuit, which is configured to operably generate an error amplified signal according to a difference between the analog reference signal and an output current related signal, wherein the output current related signal is related to the output current; and a modulation control circuit, which is configured to operably generate a PWM control signal according to the error amplified signal, to control the power switch, so as to regulate the output current such that the output current is related to the dimming duty ratio, whereby the dimming control circuit dims the LED circuit according to the PWM dimming signal.

2. The LED driving apparatus of claim 1, further comprising:

a current sensing device, which is configured to operably generate a current sensing signal according to the output current;

wherein the dimming control circuit further includes:

a current signal amplification circuit, which is configured to operably amplify the current sensing signal via fully differential configuration, to generate the output current related signal.

3. The LED driving apparatus of claim 2, further comprising:

a filter circuit coupled between the current sensing device and the current signal amplification circuit, the filter circuit being configured to operably filter a voltage across the current sensing device, to generate the current sensing signal.

4. The LED driving apparatus of claim 1, wherein the duty ratio conversion circuit includes:

a pulse generation circuit, which is configured to operably detect a starting time point of the dimming duty ratio of the PWM dimming signal to generate a starting pulse, and to operably detect an ending time point of the dimming duty ratio of the PWM dimming signal to generate an ending pulse, wherein a period of the starting pulse and a period of the ending pulse both correspond to a dimming signal period of the PWM dimming signal;

a timer clock circuit, which is configured to operably generate a timer clock signal according to a period pulse, wherein the timer clock circuit adjusts a period of the timer clock signal, to regulate a duration by which the timer clock signal counts to a predetermined full scale value, such that the period of the timer clock signal is substantially equal to the dimming signal period; wherein the period pulse corresponds to either the starting pulse or the ending pulse; and a duty ratio counter circuit, which is configured to operably count according to the timer clock signal, to generate the digital duty ratio signal, wherein the duty ratio counter circuit is triggered to start counting by the starting pulse and is triggered to stop counting by the ending pulse, so as to generate the digital duty ratio signal, wherein a ratio of a count value of the digital duty ratio signal to the predetermined full scale value corresponds to the dimming duty ratio.

5. The LED driving apparatus of claim 4, wherein the timer clock circuit includes:

a reference clock generation circuit, which is configured to operably generate a reference clock signal;

a first up-down counter circuit, which is configured to operably generate the timer clock signal according to the reference clock signal, an up-counting signal and a down-counting signal;

a period counter circuit, which is configured to operably count according to the timer clock signal and the period pulse during the dimming signal period, to generate a period counting number; and a period comparison circuit, which is configured to operably compare the period counting number with the predetermined full scale value, to generate the up-counting signal and the down-counting signal so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

6. The LED driving apparatus of claim 5, wherein the duty ratio counter circuit latches the digital duty ratio signal according to the ending pulse.

7. The LED driving apparatus of claim 4, wherein the timer clock circuit includes:

an adjustable clock generation circuit, which is configured to operably generate the timer clock signal according to an analog adjustment signal;

a second up-down counter circuit, which is configured to operably generate a digital adjustment signal according to an up-counting signal and a down-counting signal;

a second digital-to-analog conversion (DAC) circuit, which is configured to operably convert the digital adjustment signal to the analog adjustment signal;

a period counter circuit, which is configured to operably count according to the timer clock signal and the period pulse during the dimming signal period, to generate a period counting number; and a period comparison circuit, which is configured to operably compare the period counting number with the predetermined full scale value, to generate the up-counting signal and the down-counting signal so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

8. The LED driving apparatus of claim 7, wherein the duty ratio counter circuit latches the digital duty ratio signal according to the ending pulse.

9. The LED driving apparatus of claim 7, wherein the power stage circuit includes one of the following:

(1) a buck switching power stage;

(2) a boost switching power stage;

(3) a buck-boost switching power stage; or (4) a flyback switching power stage.

10. A dimming control circuit, which is configured to operably control an LED driving apparatus, wherein the LED driving apparatus includes a power stage circuit, the power stage circuit including: an inductor; and a power switch coupled to the inductor, wherein the power switch is configured to operably control the inductor to convert an input power to an output current for driving an LED circuit; wherein the dimming control circuit is configured to operably control the power switch; the dimming control circuit comprising:

a duty ratio conversion circuit, which is configured to operably convert a PWM dimming signal to a digital duty ratio signal, wherein the digital duty ratio signal corresponds to a dimming duty ratio of the PWM dimming signal;

a first digital-to-analog conversion (DAC) circuit, which is configured to operably convert the digital duty ratio signal to an analog reference signal;

an error amplifier (EA) circuit, which is configured to operably generate an error amplified signal according to a difference between the analog reference signal and an output current related signal, wherein the output current related signal is related to the output current; and a modulation control circuit, which is configured to operably generate a PWM control signal according to the error amplified signal, to control the power switch, so as to regulate the output current such that the output current is related to the dimming duty ratio, whereby the dimming control circuit dims the LED circuit according to the PWM dimming signal.

11. The dimming control circuit of claim 10, further comprising: a current signal amplification circuit, which is configured to operably amplify a current sensing signal via fully differential configuration, to generate the output current related signal, wherein the LED driving apparatus further includes a current sensing device, which is configured to operably generate the current sensing signal according to the output current.

12. The dimming control circuit of claim 10, wherein the duty ratio conversion circuit includes:

a pulse generation circuit, which is configured to operably detect a starting time point of the dimming duty ratio of the PWM dimming signal to generate a starting pulse, and to operably detect an ending time point of the dimming duty ratio of the PWM dimming signal to generate an ending pulse, wherein a period of the starting pulse and a period of the ending pulse both correspond to a dimming signal period of the PWM dimming signal;

a timer clock circuit, which is configured to operably generate a timer clock signal according to a period pulse, wherein the timer clock circuit adjusts a period of the timer clock signal, to regulate a duration by which the timer clock signal counts to a predetermined full scale value, such that the period of the timer clock signal is substantially equal to the dimming signal period; wherein the period pulse corresponds to either the starting pulse or the ending pulse; and a duty ratio counter circuit, which is configured to operably count according to the timer clock signal, to generate the digital duty ratio signal, wherein the duty ratio counter circuit is triggered to start counting by the starting pulse and is triggered to stop counting by the ending pulse, so as to generate the digital duty ratio signal, wherein a ratio of a count value of the digital duty ratio signal to the predetermined full scale value corresponds to the dimming duty ratio.

13. The dimming control circuit of claim 12, wherein the timer clock circuit includes:

a reference clock generation circuit, which is configured to operably generate a reference clock signal;

a first up-down counter circuit, which is configured to operably generate the timer clock signal according to the reference clock signal, an up-counting signal and a down-counting signal;

a period counter circuit, which is configured to operably count according to the timer clock signal and the period pulse during the dimming signal period, to generate a period counting number; and a period comparison circuit, which is configured to operably compare the period counting number with the predetermined full scale value, to generate the up-counting signal and the down-counting signal so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

14. The dimming control circuit of claim 13, wherein the duty ratio counter circuit latches the digital duty ratio signal according to the ending pulse.

15. The dimming control circuit of claim 12, wherein the timer clock circuit includes:

an adjustable clock generation circuit, which is configured to operably generate the timer clock signal according to an analog adjustment signal;

a second up-down counter circuit, which is configured to operably generate a digital adjustment signal according to an up-counting signal and a down-counting signal;

a second digital-to-analog conversion (DAC) circuit, which is configured to operably convert the digital adjustment signal to the analog adjustment signal;

a period counter circuit, which is configured to operably count according to the timer clock signal and the period pulse during the dimming signal period, to generate a period counting number; and a period comparison circuit, which is configured to operably compare the period counting number with the predetermined full scale value, to generate the up-counting signal and the down-counting signal so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

16. The dimming control circuit of claim 15, wherein the duty ratio counter circuit latches the digital duty ratio signal according to the ending pulse.

17. A dimming control method, which is configured to operably control an LED driving apparatus, wherein the LED driving apparatus includes a power stage circuit, the power stage circuit including:

an inductor; and a power switch coupled to the inductor, wherein the power switch is configured to operably control the inductor to convert an input power, so as to generate an output current for driving an LED circuit; wherein the dimming control method is configured to operably control the power switch; the dimming control method comprising:

converting a PWM dimming signal to a digital duty ratio signal, wherein the digital duty ratio signal corresponds to a dimming duty ratio of the PWM dimming signal;

converting the digital duty ratio signal to an analog reference signal; and generating a PWM control signal according to a difference between the analog reference signal and an output current related signal, to control the power switch, so as to regulate the output current such that the output current is related to the dimming duty ratio, whereby the dimming control circuit dims the LED circuit according to the PWM dimming signal.

18. The dimming control method of claim 17, further comprising:

amplifying a current sensing signal via fully differential configuration, to generate the output current related signal;

wherein the LED driving apparatus further includes: a current sensing device, which is configured to operably generate the current sensing signal according to the output current.

19. The dimming control method of claim 17, wherein the step of generating the digital duty ratio signal includes:

generating a timer clock signal according to a dimming signal period of the PWM dimming signal;

counting according to the timer clock signal;

adjusting a period of the timer clock signal, to regulate a duration by which the timer clock signal counts to a predetermined full scale value, such that the period of the timer clock signal is substantially equal to the dimming signal period; and starting to count at a starting time point of an ON-period of the PWM dimming signal according to the timer clock signal and stopping counting at an ending time point of the ON-period of the PWM dimming signal, so as to generate the digital duty ratio signal, wherein a ratio of a count value of the digital duty ratio signal to the predetermined full scale value corresponds to the dimming duty ratio.

20. The dimming control method of claim 19, wherein the step of adjusting the period of the timer clock signal includes:

generating a reference clock signal;

performing an up-counting or a down-counting according to the reference clock signal, to generate the timer clock signal;

counting according to the timer clock signal and the period pulse during the dimming signal period, to generate a period counting number; and comparing the period counting number with the predetermined full scale value, so as to control a counting direction of the first up-down counter circuit and accordingly adjust the period of the timer clock signal, to regulate the duration by which the timer clock signal counts to the predetermined full scale value, such that the period of the timer clock signal is substantially equal to the dimming signal period.

21. The dimming control method of claim 19, wherein the step of generating the timer clock signal includes:

generating a digital adjustment signal by up-counting or down-counting;

converting the digital adjustment signal to an analog adjustment signal;

generating the timer clock signal according to the analog adjustment signal;

counting according to the timer clock signal and the period pulse during the dimming signal period, to generate a period counting number; and comparing the period counting number with the predetermined full scale value, to upwardly or downwardly adjust the digital adjustment signal so as to adjust the period of the timer clock signal, whereby the duration by which the timer clock signal counts to the predetermined full scale value is regulated, such that the period of the timer clock signal is substantially equal to the dimming signal period.

* * * * *